US007240978B2

(12) United States Patent
Kobayashi et al.

(10) Patent No.: US 7,240,978 B2
(45) Date of Patent: Jul. 10, 2007

(54) SLIDING ASSISTING DEVICE

(75) Inventors: Yasutomo Kobayashi, Yamato (JP); Hiroji Sato, Tokyo (JP)

(73) Assignee: NIFCO Inc., Yokohama, Kanagawa (JP)

( * ) Notice: Subject to any disclaimer, the term of this patent is extended or adjusted under 35 U.S.C. 154(b) by 203 days.

(21) Appl. No.: 11/088,932

(22) Filed: Mar. 25, 2005

(65) Prior Publication Data

US 2005/0218759 A1 Oct. 6, 2005

(30) Foreign Application Priority Data

Mar. 30, 2004 (JP) ..... 2004-099687

(51) Int. Cl.
*A47B 88/00* (2006.01)

(52) U.S. Cl. ..... 312/333; 312/334.44

(58) Field of Classification Search ..... 312/333, 312/334.44, 334.46, 334.27, 319.1, 334.7, 312/334.1; 384/21, 19
See application file for complete search history.

(56) References Cited

U.S. PATENT DOCUMENTS

| | | | | |
|---|---|---|---|---|
| 345,227 | A * | 7/1886 | Fraser | 312/334.32 |
| 4,428,307 | A * | 1/1984 | Vasquez | 109/45 |
| 4,852,932 | A * | 8/1989 | Komeya et al. | 296/37.9 |
| 5,539,599 | A * | 7/1996 | Wilder | 360/133 |
| 6,036,291 | A * | 3/2000 | Rock | 312/333 |
| 6,039,421 | A * | 3/2000 | Fulterer | 312/333 |
| 6,398,327 | B1 * | 6/2002 | Momoze | 312/319.1 |
| 6,848,759 | B2 * | 2/2005 | Doornbos et al. | 312/319.1 |
| 7,028,370 | B2 * | 4/2006 | Hoshide et al. | 16/96 R |
| 7,185,959 | B2 * | 3/2007 | Mueller et al. | 312/331 |
| 2003/0067257 | A1 * | 4/2003 | Gasser | 312/331 |
| 2004/0104649 | A1 * | 6/2004 | Muller et al. | 312/333 |
| 2006/0017358 | A1 * | 1/2006 | Sato et al. | 312/333 |
| 2006/0017359 | A1 * | 1/2006 | Sato et al. | 312/333 |

FOREIGN PATENT DOCUMENTS

| | | |
|---|---|---|
| EP | 1 350 443 | 10/2003 |
| JP | 02-286102 | 11/1990 |

* cited by examiner

*Primary Examiner*—Janet M. Wilkens
(74) *Attorney, Agent, or Firm*—Manabu Kanesaka

(57) ABSTRACT

A sliding assisting device assists a movable body to move between a drawn-in position and a drawn-out position relative a main body. The sliding assisting device includes a unit main body provided on one of the main body and the movable body, and having a slider, a lock member, and a spring member; and an operating member provided on the other of the main body and the movable body. When the movable body is drawn out to a mid-course position from the drawn-in position or drawn-out position, the operating member displaces the lock member from a locked position to an unlocked position, so that the movable body slides from the mid-course position to the drawn-out position or drawn-in position by the spring member.

9 Claims, 10 Drawing Sheets

Fig. 2(a)
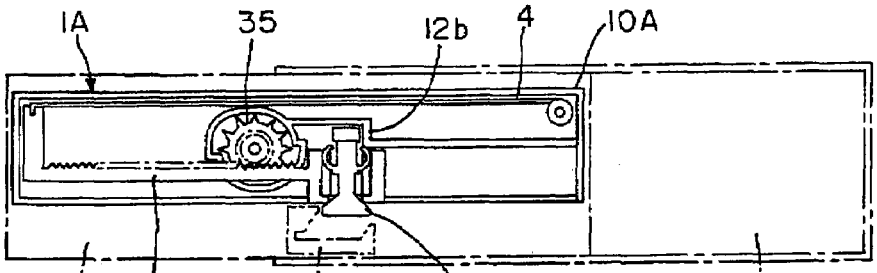
Fig. 2(b)
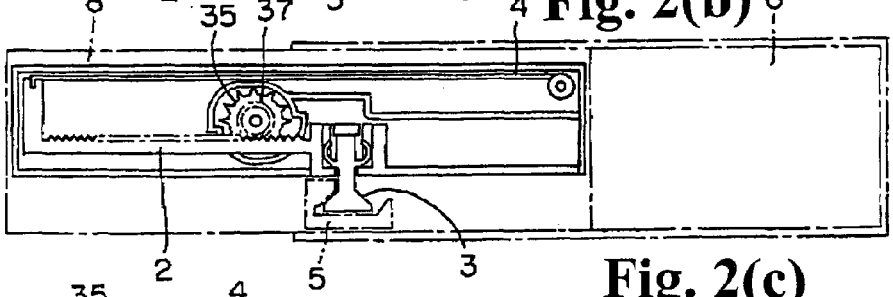
Fig. 2(c)
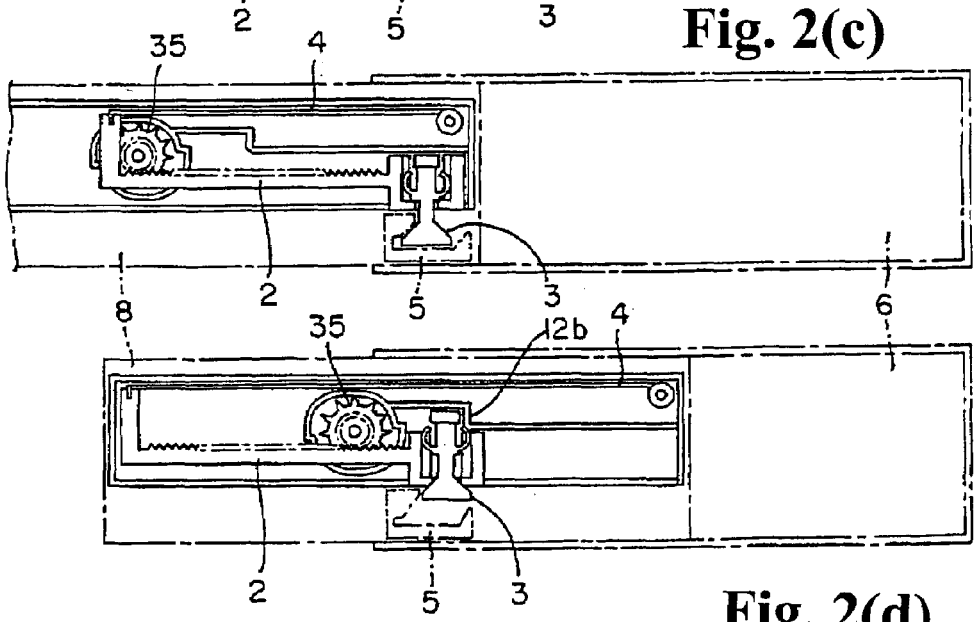
Fig. 2(d)

Fig. 3(a)
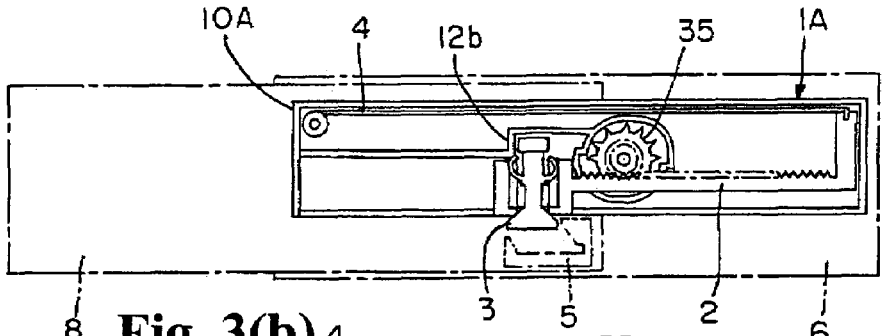
Fig. 3(b)
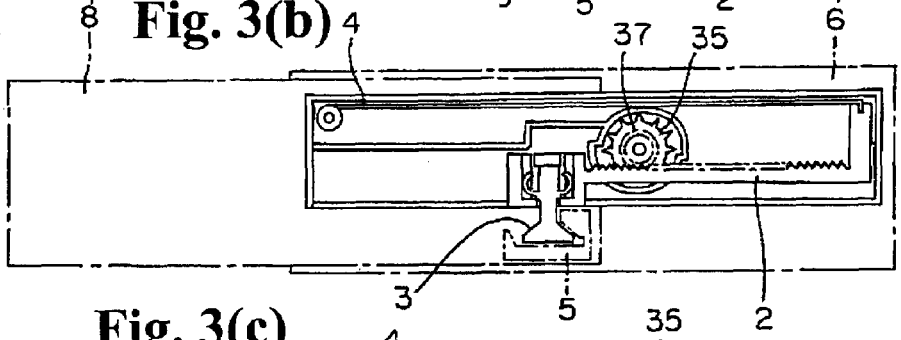
Fig. 3(c)
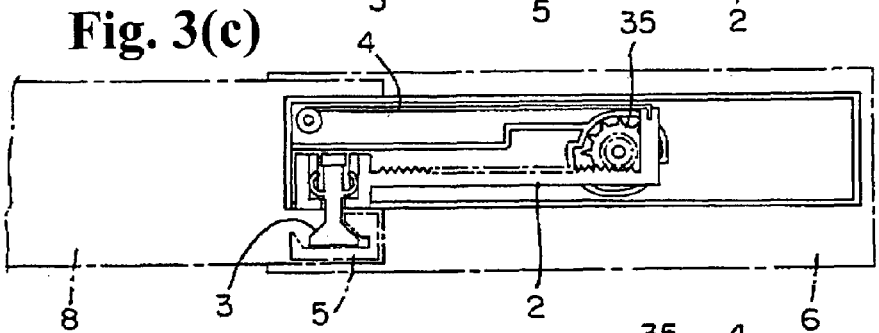
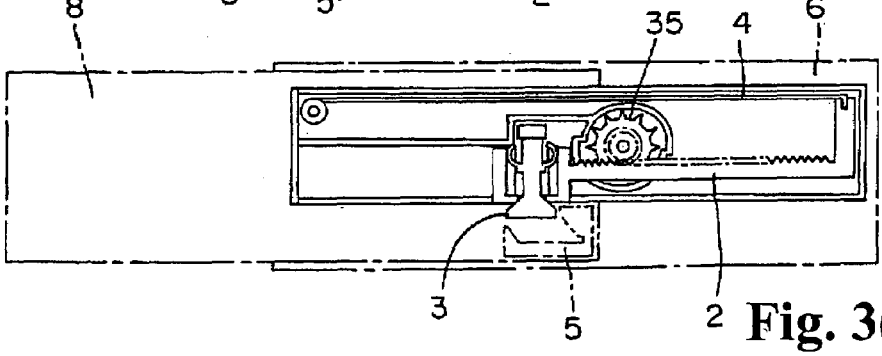
Fig. 3(d)

Fig. 5(a)
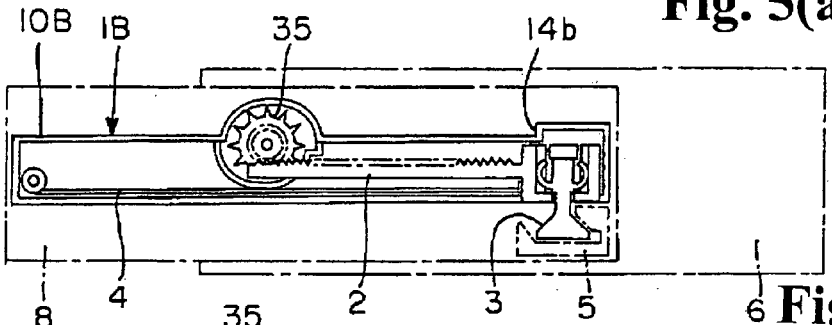
Fig. 5(b)
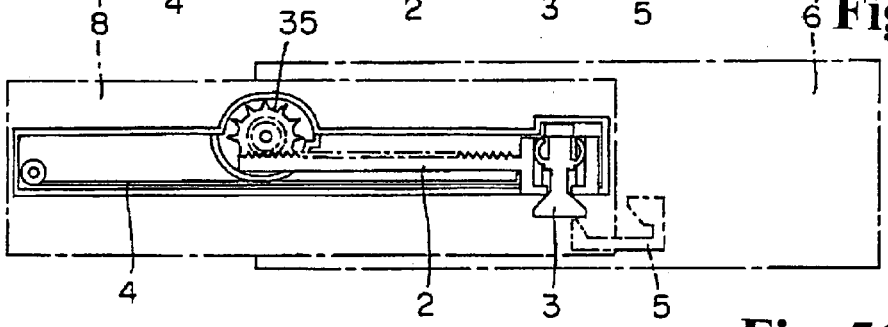
Fig. 5(c)
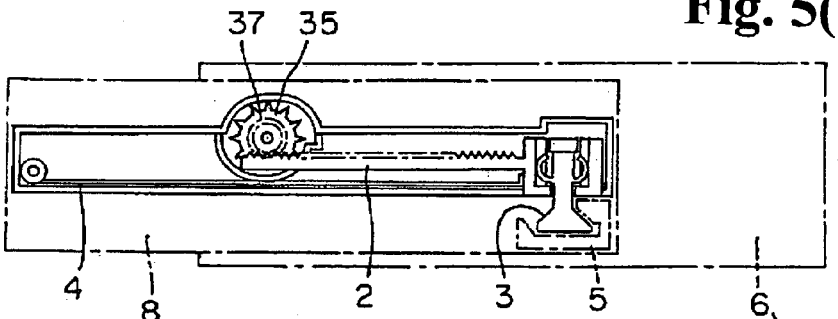
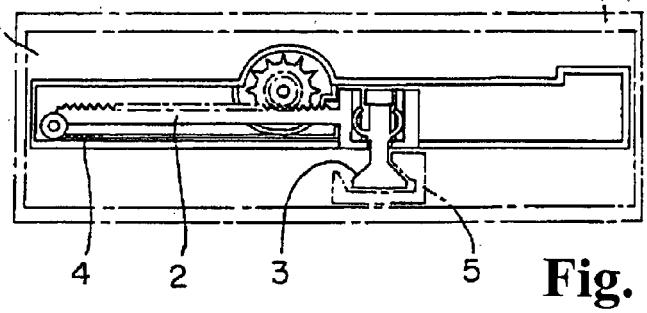
Fig. 5(d)

SLIDING ASSISTING DEVICE

BACKGROUND OF THE INVENTION AND RELATED STATEMENT

The present invention relates to a sliding assisting device for assisting a movable body such as a drawer and a lid to slide relative to a main body between a drawn-in position and a drawn-out position.

In a structure in which a movable body is switched to slide between a drawn-in position and a drawn-out position relative to a main body, when all the sliding operations to a drawn-in position and a drawn-out position are performed manually, it may cause fatigue and lack high quality. Accordingly, as disclosed in Patent Document 1, a movable body is urged to slide automatically in one direction toward the drawn-out position or the drawn-in position.

FIGS. 10(*a*) and 10(*b*) show a drawer apparatus disclosed-in Patent Document 1. FIG. 10(*a*) shows a drawn-in position of a movable body (not shown), and FIG. 10(*b*) shows a drawn-out position. Reference numeral 50 is a sidewall of the main body, reference numeral 55 is a drive pin formed on the movable body, reference numeral 60 is a tilting part placed between the main body sidewall and the movable body, and reference numeral 65 is a spring member. A guide track 51 is provided in the main body sidewall 50. The guide track 51 has a straight part 51*a* extending horizontally in a front-to-back direction, and a bow-shaped part 51*b* on a front side (right side in the drawing). The tilting part 60 has a slot 61 opening upwardly and a diagonal sidewall 62 extending from a front side of the slot 61. Bolts 63 engage in the guide track 51.

The spring member 65 accumulates a force in a process of sliding the movable body from the drawn-in position to the drawn-out position. One end of the spring member 65 is fixed on the main body, and the other end is fixed on the tilting part 60. The movable body is built into the main body in a state in which the drive pin 55 engages the slot 61.

When the movable body slides from the drawn-in position to the drawn-out position, the tilting part 60 moves along the straight part 51*a* of the guide track 51, and then is tilted forward at the bow-shaped part 51*b*. The drive pin 55 also moves from the slot 61 to a diagonal sidewall 62. Accordingly, the movable body is locked in the drawn-out position against the force of the spring member 65. When the movable body is pushed backward, the drive pin 55 returns from the diagonal wall part 62 to the slot 61, so that the movable body is drawn in with the force accumulated in the spring member 65. In Patent Document 1, the movable body slides to the drawn-in position with the force of the spring member 65, so that the movable body does not bounce back and is not drawn out again even when the movable body is strongly drawn in.

Patent Document 1: Japanese Patent Publication (Kokoku) No. 05-023763

In the conventional structure, the movable body slides automatically almost entirely from the drawn-out position to the drawn-in position. However, it is necessary to provide the strong pulling force to move the movable body from the drawn-in position to the drawn-out position, thereby deteriorating convenience. The drive pin 55 moves out from the slot 61 with a front slope of the tilting member 60 and engages the diagonal sidewall 62 as the lock mechanism for locking the movable body against the force of the spring member 65. Accordingly, it is difficult to strongly lock the movable body, thereby releasing the movable body by vibrations and the like.

When the movable body (drive pin 55) is draw out, an opening of the slot 61 provided in the tilting member 60 receives a large load accompanying the accumulation of the force of the spring member 65. Accordingly, it is desirable that the drive pin 55 enters deep in the opening. However, it is also necessary to easily release the drive pin 55 accompanying forward tilting of the tilting member 60, thereby limiting the opening. The conventional structure does not have an apparatus for assisting both operations of sliding the movable body toward the drawn-in position and toward the drawn-out position, thereby limiting the operation.

In view of the problems described above, a purpose of the present invention is to provide a sliding assisting device with a comparatively simple structure, thereby improving convenience and quality.

Further objects and advantages of the invention will be apparent from the following description of the invention.

SUMMARY OF THE INVENTION

According to a first aspect of the present invention, a sliding assisting device assists an operation of a movable body drawing out from a drawn-in position to a drawn-out position relative to a main body. The sliding assisting device comprises a drawing-out unit main body provided on one of the main body and the movable body. The drawing-out unit main body includes a slider capable of sliding in a same direction as the movable body; a lock member built into the slider and capable of moving in a direction roughly orthogonal to the sliding direction of the movable body; and a spring member capable of accumulating a force in a process of sliding the movable body in the direction from the drawn-out position to the drawn-in position. The sliding assisting device also comprises an operating member provided on the other of the main body and the movable body. When the movable body is drawn out to a mid-course position from the drawn-in position, the operating member shifts the lock member from a locked position for locking the movable body to the slider to an unlocked position for releasing the lock, so that the movable body can slide from the mid-course position to the drawn-out position with the force of the spring member.

According to a second aspect of the present invention, a sliding assisting device assists an operation of a movable body drawing in from a drawn-out position to a drawn-in position relative to a main body. The sliding assisting device comprises a drawing-in unit main body provided on one of the main body and the movable body. The drawing-out unit main body includes a slider capable of sliding in a same direction as the movable body; a lock member built into the slider and capable of moving in a direction roughly orthogonal to the sliding direction of the movable body; and a spring member capable of accumulating a force in a process of sliding the movable body in the direction, from the drawn-in position to the drawnout position. The sliding assisting device also comprises an operating member provided on the other of the main body and the movable body. When the movable body is drawn in to a mid-course position from the drawn-out position, the operating member shifts the lock member from a locked position for locking the movable body to the slider to an unlocked position for releasing the lock, so that the movable body can slide from the mid-course position to the drawn-in position with the force of the spring member.

According to a third aspect of the present invention, a sliding assisting device assists operations of a movable body drawing in from a drawn-out position to a drawn-in position and drawing out from the drawn-in position to the drawn-out position relative to a main body. The sliding assisting device comprises a drawing-in drawing-out unit main body provided on one of the main body and the movable body. The drawing-out unit main body includes a plurality of sliders capable of sliding in a same direction as the movable body; lock members built into the sliders; and a spring member connecting the sliders together and capable of accumulating a force in a process of sliding the movable body in directions from the drawn-in position to the drawn-out position and from the drawn-out position to the drawn-in position. The sliding assisting device also comprises an operating member provided on the other of the main body and the movable body. When the movable body is drawn in to a mid-course position from the drawn-out position or drawn out to the midcourse position from the drawn-in position, the operating member shifts the lock members from a locked position for locking the movable body to the sliders to an unlocked position for releasing the lock, so that the movable body can slide from the mid-course position to the drawn-in position and from the mid-course position to the drawn-out position with the force of the spring member.

In the structure of each of the aspects, one of the drawing-out unit main body, the drawing-in unit main body, and the drawing-out drawing-in unit main body is provided on one of the main body and the movable body. The operating member is provided on the other of the main body and the movable body for moving the lock member of the corresponding unit in the direction roughly orthogonal to the sliding direction of the movable body. Each of the unit main bodies includes the slider, the lock member, and the spring member, and is combined with the operating member.

In an operation of each of the aspects, the spring member accumulates a force in a process of sliding the movable body, so that the movable body slides automatically with the accumulated force. The lock member of each unit main body receives a load from the operating member, so that the lock member switches between the locked position for locking the movable body to the slider (so that the slider does not slide alone) and the unlocked position releasing the lock (the slider slides). As an additional advantage, it is possible to make a shape of the lock member same as that of the operating member, thereby reducing manufacturing cost through shearing the main components.

In the invention described above, the operating member may have a first cam part capable of displacing the lock member to the locked position and a second cam part capable of displacing the lock member to the unlocked position. Each unit main body may have a damper provided inside a case retaining the slider, the lock member, and the spring member for damping a sliding speed of the movable body through the slider. The damper may have plural projections on an outer perimeter of a damper main body, so that the damper can rotate one direction through the projections relative to a damper receiving part provided in the case. The damper may have a gear engaging a rack provided on the slider.

In the present invention, the sliding assisting device has the following advantages. In the first aspect, with the drawing-out unit main body and the operating member, it is possible to slide the movable body automatically in the process of switching from the drawn-in position to the drawn-out position, that is, from the mid-course position to the drawn-out position, with the force of the spring member, thereby improving convenience.

In the second aspect, with the drawing-in unit main body and the operating member, it is possible to slide the movable body automatically in the process of switching from the drawn-out position to the drawn-in position, that is, from the mid-course position to the final drawn-in position, with the force of the spring member, thereby improving convenience.

In the third aspect, with the drawing-out/drawing-in unit main body and the operating member, it is possible to slide the movable body automatically in the process of switching from the drawn-in position to the drawn-out position, and in the process of switching from the drawn-out position to the drawn-in position, that is, from the mid-course position to the final drawn-out position and the final drawn-in position, with the force of the spring member, thereby improving convenience. In particular, it is possible to assist drawing in and drawing out by the single unit construction, thereby obtaining excellent assemble and maintenance characteristics, and eliminating constraint of a setup space.

In the fourth aspect, the lock member of each unit main body is displaced to the locked position or the unlocked position while abutting against the first cam part or the second cam part of the operating member. Accordingly, it is possible to arbitrarily adjust a depth for locking the lock member in the locked position, thereby obtaining stable lock strength.

In the fifth aspect, the movable body is damped by the damper, so that the movable member does not slide rapidly by the force of the spring, thereby improving quality.

In the sixth aspect, the main body of the damper rotates in one direction relative to the damper receiving part with the projections on the outer perimeter and steps on the receiving part. Accordingly, it is possible to provide a function as a so-called one-way type in which a movement only in a predetermined rotational direction is damped by just setting shapes of the outer perimeter of the main body.

In the seventh aspect, the damper has the gear for engaging the rack on the slider, thereby obtaining stable damping.

BRIEF DESCRIPTION OF THE DRAWINGS

FIGS. 2(*a*) to 2(*d*) are schematic views showing an operation of the sliding assisting device shown in FIG. 1;

FIGS. 3(*a*) to 3(*d*) are schematic views corresponding to FIGS. 2(*a*) to 2(*d*) showing an operation of a modified example of the sliding assisting device shown in FIG. 1;

FIGS. 5(*a*) to 5(*d*) are schematic views showing an operation of the sliding assisting device shown in FIG. 4;

DETAILED DESCRIPTION OF PREFERRED EMBODIMENTS

Figure 1:
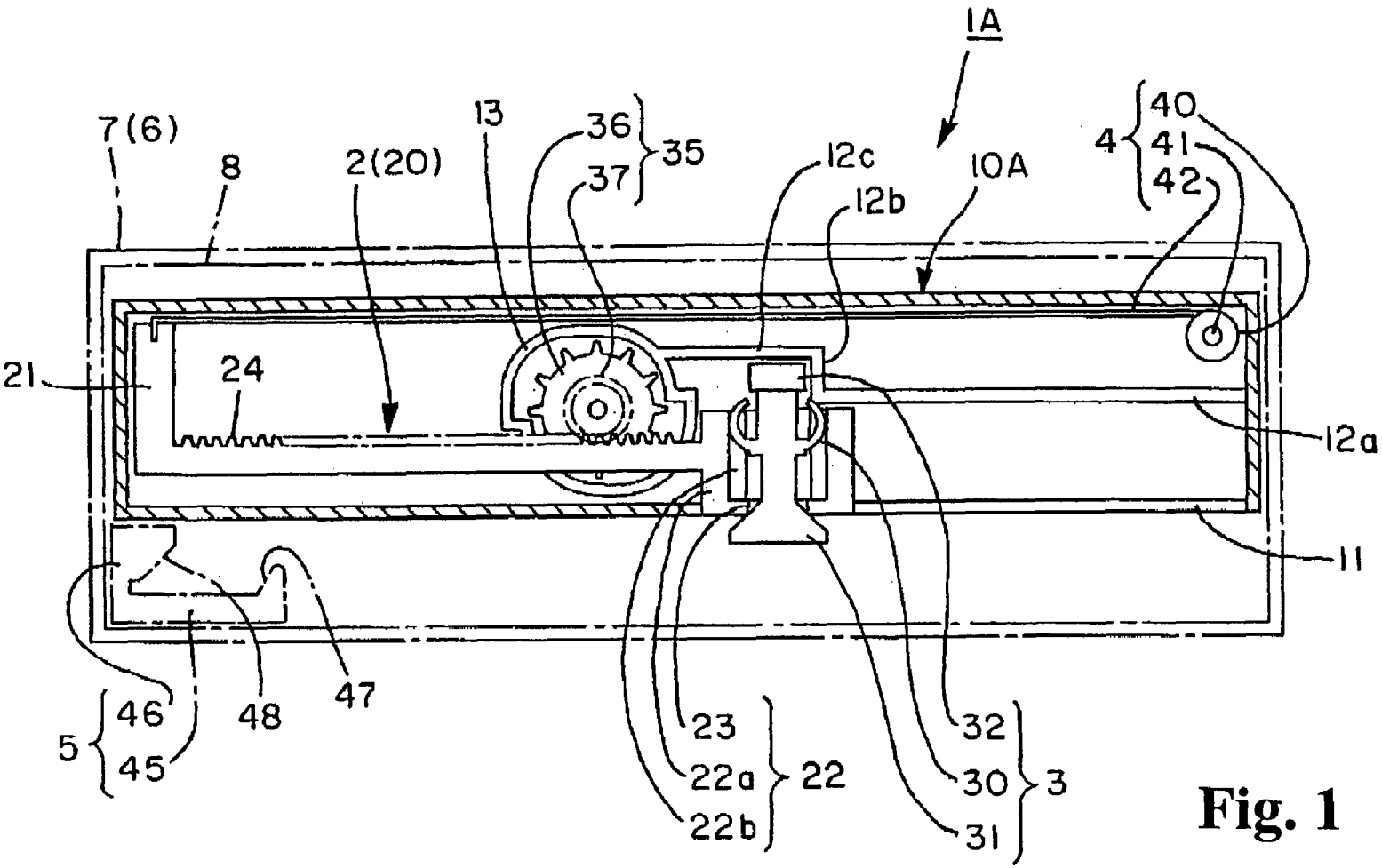
FIG. 1 is a cross sectional view showing a sliding assisting device according to a first embodiment of the present invention.
Figure 4:
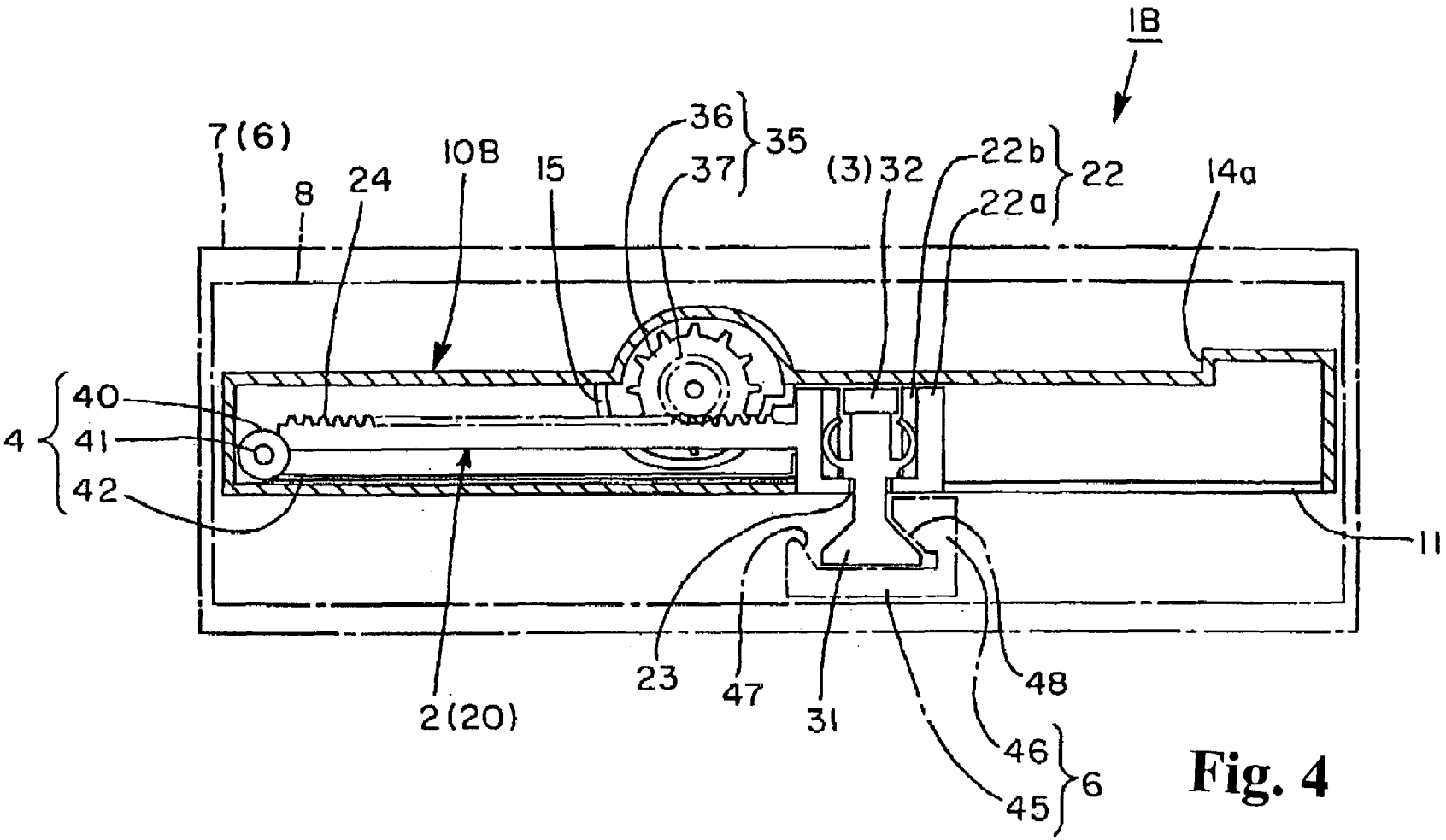
FIG. 4 is a cross sectional view showing a sliding assisting device according to a second embodiment of the present invention.
Figure 6:
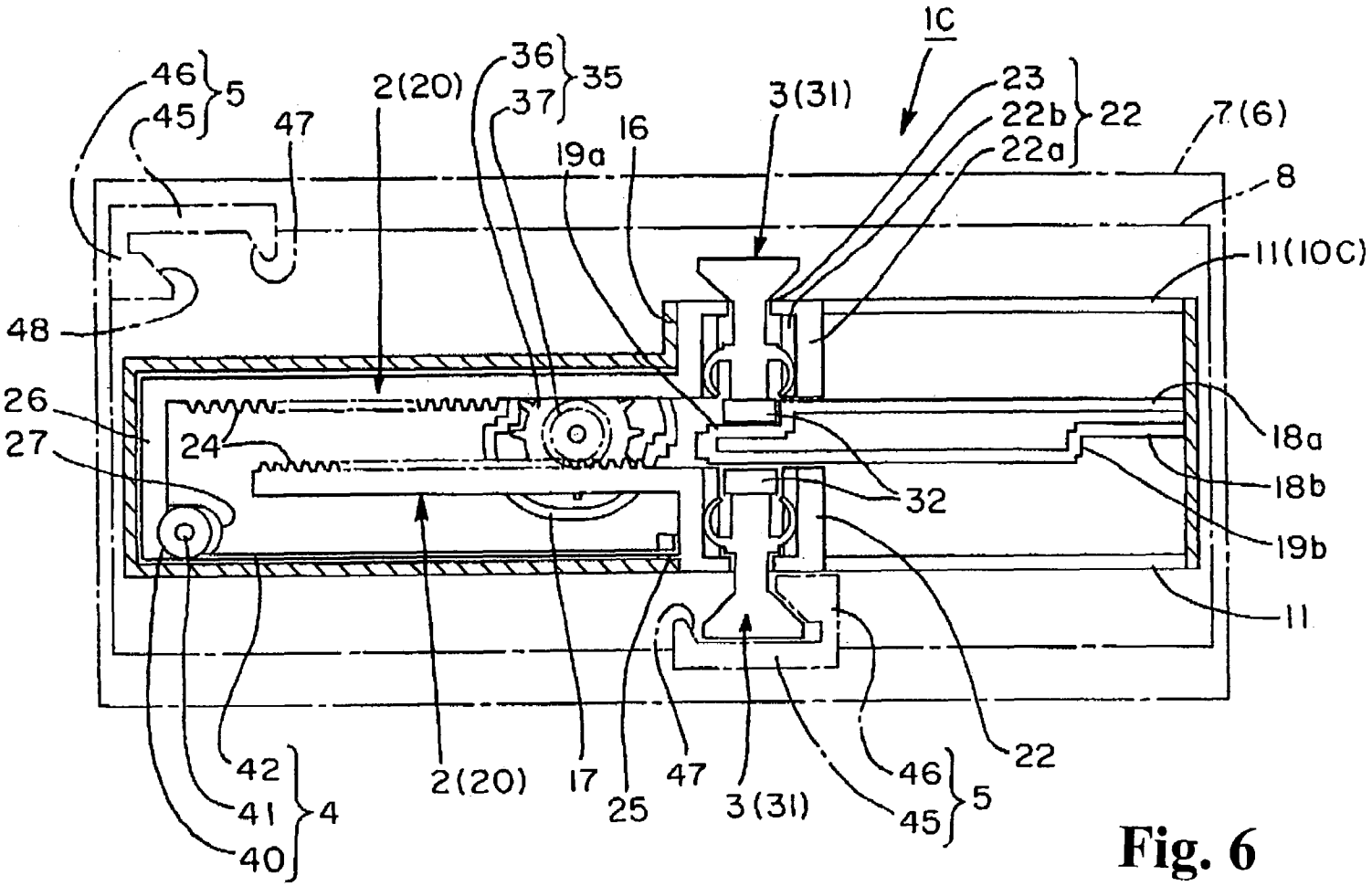
FIG. 6 is a cross sectional view showing a sliding assisting device according to a third embodiment of the present invention.
Figure 7A:
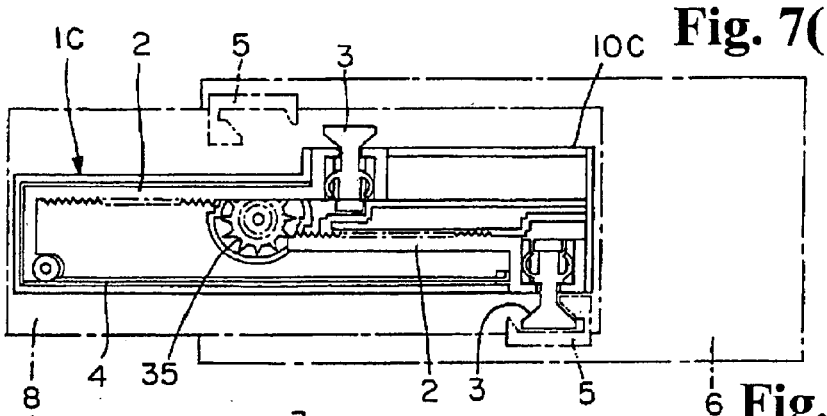
FIGS. 7(*a*) to 7(*d*) are schematic views showing an operation of the sliding assisting device shown in FIG. 6.
Figure 7B:
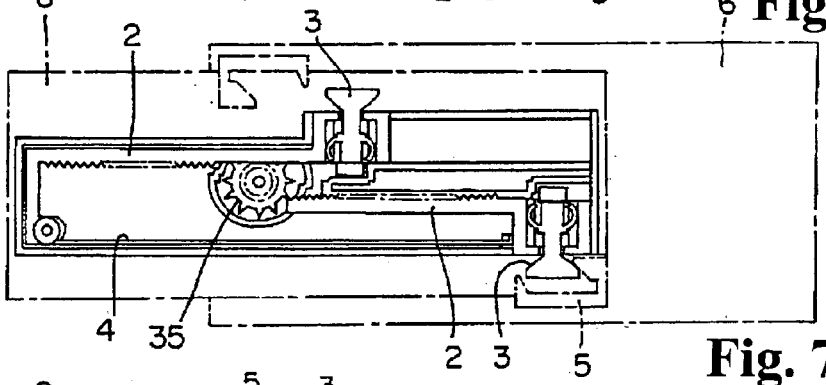
Figure 7C:
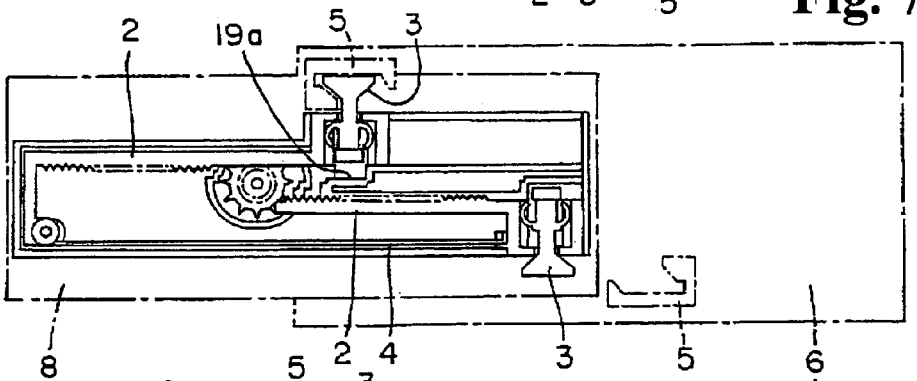
Figure 7D:
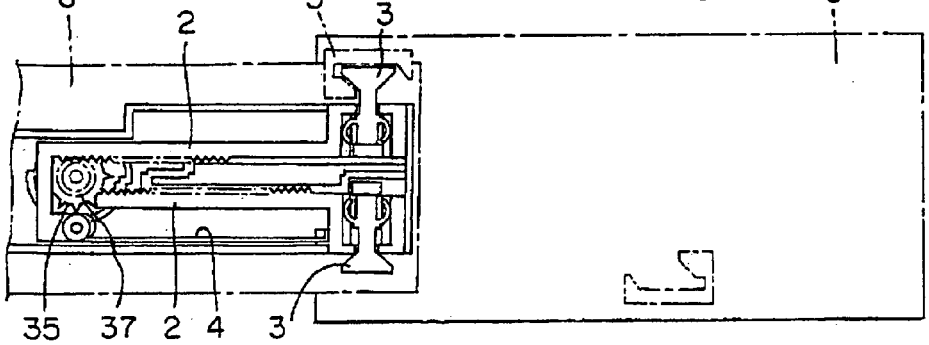
Figure 8A:
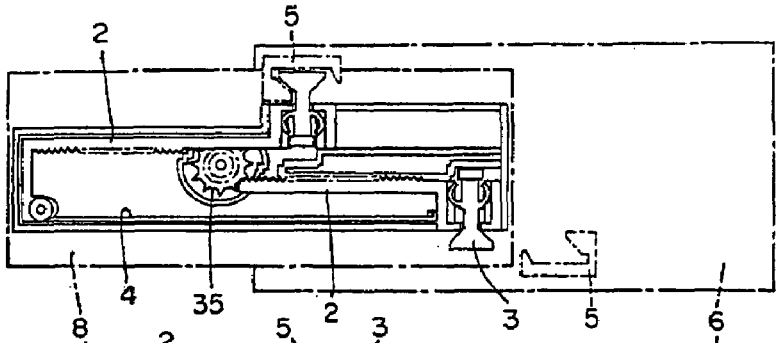
FIGS. 8(*a*) to 8(*d*) are schematic views similar to FIGS. 7(*a*) to 7(*d*) showing the operation of the sliding assisting device shown in FIG. 6.
Figure 8B:
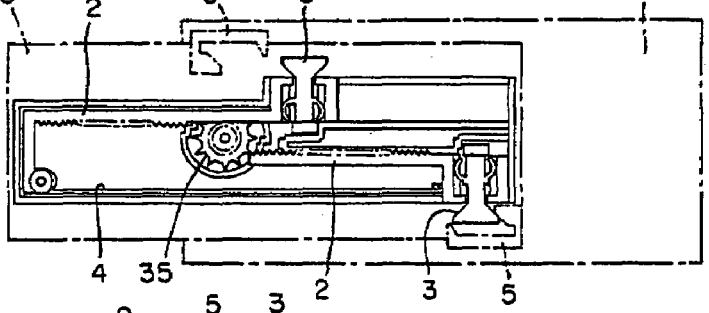
Figure 8C:
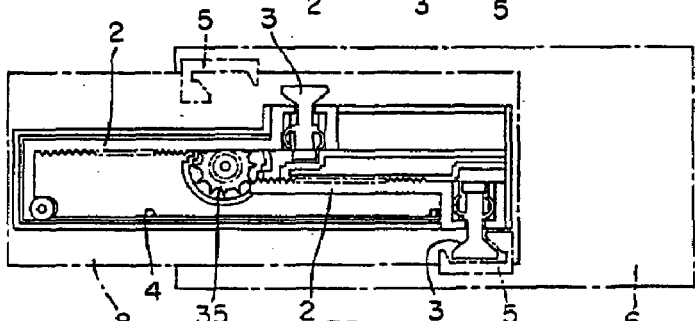
Figure 8D:
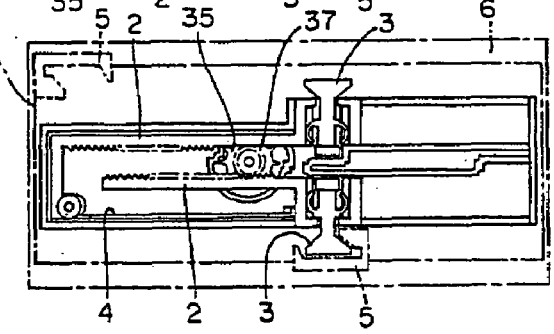
Figure 9:
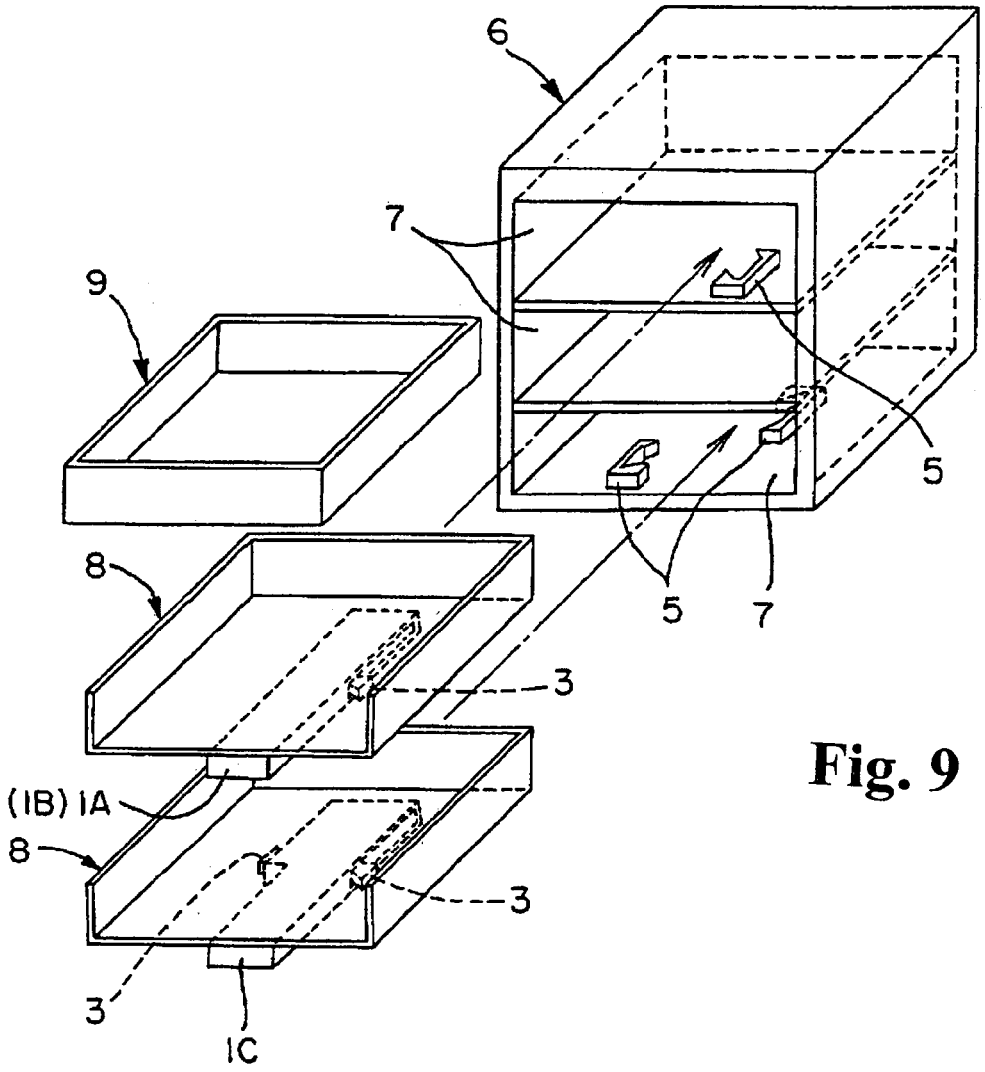
FIG. 9 is a view showing a relationship between a movable body and a main body.
Figure 10A:
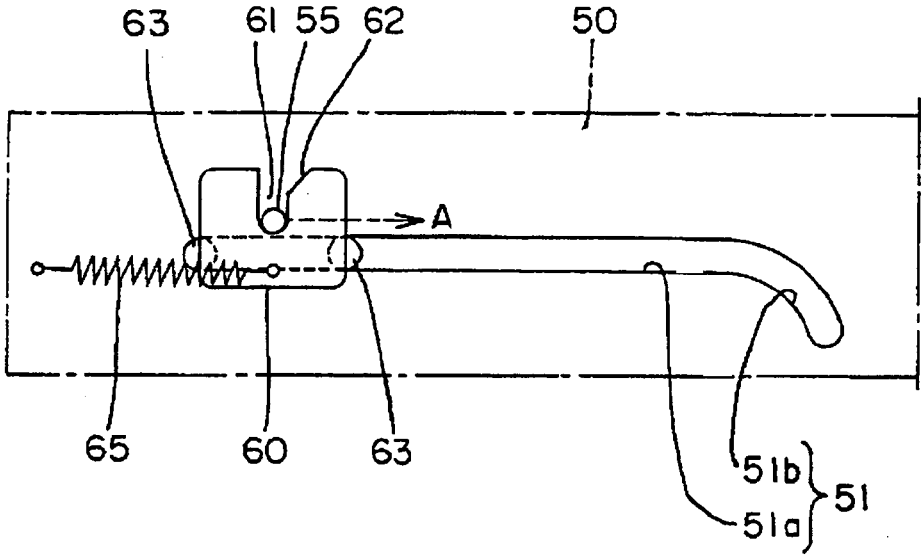
Fig. 10(a) Prior Art
FIGS. 10(*a*) and 10(*b*) are schematic views for explaining problems of a conventional device.
Figure 10B:
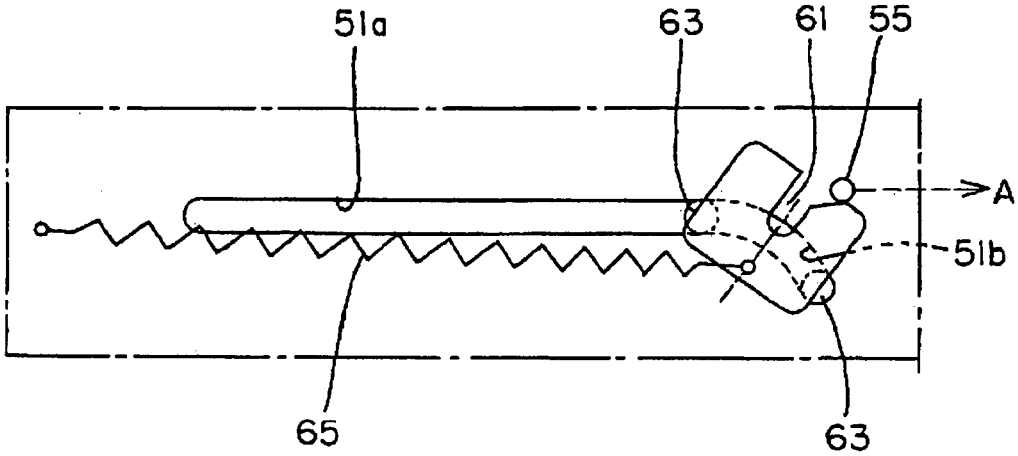
Fig. 10(b) Prior Art

Hereunder, embodiments of the present invention will be explained while referring to the accompanying drawings. FIG. 1 and FIGS. 2(*a*) to 2(*d*) show a first embodiment and FIGS. 3(*a*) to 3(*d*) show a modified example. FIG. 4 and FIGS. 5(*a*) to 5(*d*) show a second embodiment. FIG. 6 to FIG. 8(*d*) show a third embodiment. FIGS. 2(*a*) to 2(*d*), 3(*a*) to 3(*d*), 5(*a*) to 5(*d*), 7(*a*) to 7(*d*), and 8(*a*) to 8(*d*) show operations of the apparatus of each embodiment or modified example, and FIG. 9 shows an example of use of the apparatus of the present invention. In the explanation below, after giving an overview of the use of the apparatus of the present invention, it is described in detail in the order of the first embodiment and modified example, second embodiment and modified example, and third embodiment and modified example. Also, the same symbols are assigned to the same members and locations in the drawings, and descriptions thereof are omitted. In FIGS. 2(*a*) to 2(*d*), 3(*a*) to 3(*d*), 5(*a*) to 5(*d*), 7(*a*) to 7(*d*), and 8(*a*) to 8(*d*), symbols are assigned only to main members, and detailed parts are referred to FIG. 1, FIG. 4, and FIG. 6.

EXAMPLE OF THE USE OF EACH APPARATUS OF THE INVENTION

The sliding assisting device of the present invention is constituted by one of a drawing-out unit main body 1A, a drawing-in unit main body 1B, and a drawing-out/drawing-in unit main body 1C, and an operating member 5. The sliding assisting device assists the operation of switching to slide the movable body to the drawn-in position and the drawn-out position.

FIG. 9 shows one example of a main body and a movable body. The main body 6 is a storage apparatus having space parts 7 opened on the front formed on plural levels. The movable body 8 has a tray 9 attached so as to be capable of installation and removal inside, and it is assembled into the corresponding space part 7 of the main body 6 so as to be switched to slide to the drawn-in position and the drawn-out position.

In this example, one of the drawing-out unit main body 1A, the drawing-in unit main body 1B, and the drawing-out/drawing-in unit main body 1C is placed on the movable body 8, and the operating member 5 is placed on each space part 7 in correspondence with said unit main body. Regarding the placement of the members, as shown in the modified example in FIGS. 3(*a*) to 3(*d*), one of the drawing-out unit main body 1A, the drawing-in unit main body 1B, and the drawing-out/drawing-in unit main body 1C may be placed on the space part 7 (main body 6), and the operating member 5 may be placed on the movable body 8.

First Embodiment

In the sliding assisting device in FIG. 1, the drawing-out unit main body 1A is placed on a bottom surface side of the movable body 8, and the operating member 5 is placed on a inside bottom surface side of a space part 7 on a side of the main body. The drawing-out unit main, body 1A is constituted by a slider 2 capable of sliding in the same direction as the movable body 8, a lock member 3 built into the slider 2 and capable of being displaced to sway in a direction roughly orthogonal to the sliding direction of the movable body 8, and a spring member 4 capable of accumulating force in the process of sliding of the movable body 8, and these are built into a case 10A. The detailed parts are as follows.

The case 10A has a rectangular container shape elongated in the sliding direction of the movable body 8 and is flat as shown in FIG. 9. On one side in the lengthwise direction, a long groove 11 is formed from about the center position in the front-to-back direction to the back end. On the inside bottom surface, it has a straight rib 12*a* which extends from the back side to near about the center, a vertical rib 12*b* which is connected to the straight rib 12*a*, and a straight rib 12*c* which is connected to the vertical rib 12*b*. Also, it has a roughly arc-shaped dividing rib 13 for damper placement which is connected to the straight rib 12*c*.

A damper 35 is placed inside the dividing rib 13. That is, the dividing rib 13 forms a damper receiving part, and one part becomes a step part. The damper receiving part is made such that a main body 36 of the damper 35 to be described later is rotated only in one direction via teeth or projections on the side of the main body and the step part on the side of the rib 13. In terms of shape, in addition to the shape in FIG. 1, it also may be designed to a shape such that the dividing rib 13 is rotated about 90 degrees. The above case 10A, after building in the slider 2 and the lock member 3 as well as the spring member 4, is attached to the bottom surface of the movable body 8 by a setscrew, or the like.

The damper 35 has a main body 36 which has plural teeth or projections formed on the outer perimeter and is filled with operating oil, and a gear 37 which is supported to rotate freely via a shaft, or the like, on the main body 36 and is subject to resistance of the operating oil. The damper 35 idle-rotates when it rotates clockwise as in FIG. 2(*a*), and it damps the member on the other side (slider 2) via the gear 37 when it rotates counterclockwise as in FIG. 2(*c*).

In this structure, the damper 35 is placed inside the dividing rib 13, that is, the damper receiving part, so that the main body 36 is idle-rotated in one direction via the teeth or projections on the outer perimeter, and it damps only when the movable body 8 is slid by the force of the spring member 4 to be described later. That is, the damping structure does not apply damping action when the main body 36 rotates, but it comes to a state capable of damping via the gear 37 in the state incapable of rotation.

The slider 2 is constituted by a long and thin long piece part 20, a front-end bent part 21 where the front end of the long piece part 20 is bent roughly in an L shape, and a holding part 22 which is provided at the back end of the long piece part 20. On the long piece part 20, a rack 24 is provided along one side for engaging the gear 37. The holding part 22 is formed roughly in a recessed shape in section. On the opposite pieces of the recessed shape, an inner part 22*b* is formed one step shorter than an outer part 22*a*, and also a small opening or hole 23 is provided in the piece linking the opposite pieces together. A total size of the slider 2 is a length which extends from the front side (left side in FIG. 1) inside the case 10A to near the vertical rib 12*b*. The long piece part 20 is supported to slide freely on the dividing rib 13, and the holding part 22 is supported to slide freely in the long groove 11.

The lock member 3 is formed roughly in a shaft or pin shape, and it is constituted by elastic pieces 30 which are placed protruding on both sides of the shaft part, a striking part 31 on the lower end, and a head part 32 on the upper end. The striking part 31 is formed roughly in a trapezoidal shape, and both sides are formed as sloping sides. Also, the lock member 3 is placed in a state in which it elastically contacts the inner part 22*b* of the holding part 22 via the two elastic pieces 30, and the striking part 31 is made to project out from the hole 23.

Accordingly, the lock member 3 is placed on the holding part 22 in a direction orthogonal to (same as intersecting) the sliding direction of the slider 2, and it becomes capable of moving accompanying the elastic deformation of the two elastic pieces 30. Usually, the lock member 3 is placed in the locked position with the head part 32 between the vertical rib 12*b* and the straight rib 12*c*, that is, with the head part 32 restricted by the vertical rib 12*b*, as in FIG. 1. Also, the lock member 3 is switched to the unlocked position in which the head part 32 becomes in non-contact with the vertical rib 12*b*, by being displaced to sway in the direction orthogonal to the sliding direction of the slider 2 via the operating member 5 to be described later.

The spring member 4 is a constant-pressure spring in which a spring plate 42 wound around a spool 41 is drawn out from a housing 40, and it is attached inside the case 10A between the base end side of the straight rib 12*a* and the corresponding case sidewall. Also, the spring member 4 forces the slider 2 to the back of the case by having the drawn-out end of the spring plate 42 fixed to the front-end bent part 21 of the slider 2. In the assembled state, the slider 2 is kept in the initial position in FIG. 1 against the force of the spring member 4 because the lock member 3 is in the locked position.

The operating member 5 is formed roughly in an L shape, and it is constituted by a long piece part 45 which is placed in the sliding direction of the slider 2, and a short piece part 46 which is placed in a direction intersecting the sliding direction of the slider 2. The long piece part 45 has a first cam part 47 which is provided on the end part and protrudes upward. The first cam part 47 enables switching of the lock member 3 from the unlocked position to the locked position as in FIG. 2(*d*). The short piece part 46 has a second cam part 48 which receives the striking part 31 of the lock member 3 between it and the long piece part 45 and contacts one sloping side of the striking part 31. The second cam part 48 enables switching of the lock member 3 from the locked position to the unlocked position as in FIG. 2(*b*). The operating member 5 is attached to the front side of the inside bottom surface of the space part 7 on the side of the main body as in FIG. 1 and FIG. 9.

(Operation)

FIGS. 2(*a*) to 2(*d*) show the operation when using the sliding assisting device of the first embodiment. That is: FIG. 2(*a*) is a state in which the movable body 8 is in mid-course of being drawn out in which it is being drawn out manually from the drawn-in position in which it is held in the space part 7 on the side of the main body as in FIG. 1. In this process, the lock member 3 of the drawing-out unit main body 1A is in the locked position in which it is restricted by the vertical rib 12*b* (position in which the movable body 8 and the slider 2 are operationally linked, or, position in which relative sliding of the slider by itself is disabled), and the slider 2 is most strongly subject to the force of the spring member 4.

FIG. 2(*b*) is a state in which the movable body 8 is further drawn out and is immediately before the lock member 3 is switched to the unlocked position by the operating member 5. In this process, the lock member 3 is displaced in position to the side of the long piece part 45, that is, the unlocking direction, as a result of contacting the striking part 31 to the cam surface of the second cam part 48 and sliding the striking part 31 by the cam action of that cam surface.

FIG. 2(*c*) is a state in which the lock member 3 is switched to the unlocked position (position in which the operational link between the movable body 8 and the slider 2 is released, or, position in which relative sliding of the slider by itself is enabled), whereby the movable body 8 slides automatically by the force of the spring member 4 up to the final drawn-out position on the slider 2 which is restricted in position by the operating member 5. In this structure, although the lock member 3 is forced upward by the first cam part 47 of the operating member 5 after being switched to the unlocked position, it does not move upwardly because it is positioned beneath the straight rib 12*a* in FIG. 1 by further drawing-out of the movable body 8. Also, in this structure, while going from FIG. 2(*b*) to FIG. 2(*c*), the damper 35 damps the sliding speed of the movable body 8 via the engagement between the rack 24 and the gear 37. As a result, the movable body 8 slides at a moderate speed from the mid-course position to the final drawn-out position.

FIG. 2(*d*) shows a state when the movable body 8 is operated to be drawn in from the drawn-out position. In this drawing-in process, in the initial stage, because the slider 2 is restricted in position via the lock member 3 and the operating member 5, the spring member 4 accumulates force in a gradually increasing manner accompanying the sliding of the movable body 8. When the lock member 3 reaches the vertical rib 12*b* from the straight rib 12*a* as in the same drawing, the striking part 31 is contacted with the cam surface of the first cam part 47, and the lock member 3 is displaced to sway in the direction of the straight rib 12*c*, that is, the locked position, by the cam action of that cam surface. Also, the locked position, just as in FIG. 2(*a*), becomes the state in which the slider 2 is most removed from the attachment position of the spring member 4, that is, the state in which the force is spring-charged to the maximum. Although the drawing-in operation of the movable body 8 requires comparatively great force from the drawn-out position to the mid-course position, it is performed with weak force from that mid-course position to the final drawn-in position. In other words, because the drawing-in operation requires a prescribed force only at the start and afterwards does not require force, the convenience of use can be improved.

MODIFIED EXAMPLE

FIGS. 3(*a*) to 3(*d*) show a modified example of the first embodiment in which the above drawing-out unit main body 1A is placed on the main body 6 (inside bottom surface of the space part 7) and the operating member 5 is placed on the movable body 8. In this modified example, as is clear from comparison with FIGS. 2(*a*) to 2(*d*), the relationship of the members is inverted. However, the operation, although the explanation is omitted, is substantially the same as in the first embodiment as is clear from comparison between FIGS. 2(*a*) to 2(*d*) and FIGS. 3(*a*) to 3 (*d*).

Second Embodiment

In the sliding assisting device in FIG. 4, the drawing-in unit main body 1B is placed on the bottom surface side of the movable body 8, and the operating member 5 is placed on the inside bottom surface side of the space part 7 on the side of the main body. The drawing-in-unit main body 1B is constituted by a slider 2 which is capable of sliding in the same direction as the movable body 8, a lock member 3 which is built into the slider 2 and is capable of being displaced to sway in a direction roughly orthogonal to the sliding direction of the movable body 8, and a spring member 4 which is capable of accumulating force in the process of sliding of the movable body 8, and these are built into a case 10B.

The case 10B has a rectangular container shape which is long in the sliding direction of the movable body 8 and is flat as in FIG. 9. On one side in the lengthwise direction, a long groove 11 is formed from about the center position in the front-to-back direction to the back end. On the other side in the lengthwise direction, a vertical wall 14*a* which becomes as a wide step at the back side and functions in the same manner as the above vertical rib 12*b*, and a semicircular arc wall 14*b* provided in about the center front-to-back, are integrally provided. On the inside bottom surface, it has an arc rib 15 which partitions a damper placement part between it and the arc wall 14*b*.

A damper 35 is placed in the place partitioned by the arc wall 14*b* and the arc rib 15. That is, the arc wall 14*b* and the arc rib 15 form a damper receiving part, and a part becomes a step part. In the damper receiving part, the damper 35 is placed to be capable of rotating in one direction just as in the first embodiment. In terms of shape, in addition to the shape in FIG. 4, it also may be designed to a shape such that the arc wall 14*b* and the arc rib 15 are rotated about 90 degrees. The above case 10B, after building in the slider 2 and the lock member 3 as well as the spring member 4, is attached to the bottom surface of the movable body 8 by a setscrew, or the like.

The damper 35 has a main body 36 and a gear 37 just as in the first embodiment. The damper 35 idle-rotates when it rotates counterclockwise as in FIG. 5(*a*), and damps the member on the other side (slider 2) via the gear 37 when it rotates clockwise as in FIG. 5(*c*). Also, in this structure, the main body 36 idle-rotates in one direction via the teeth on the outer perimeter, and damps only when the movable body 8 is slid by the force of the spring member 4 to be described later.

The slider 2 is constituted by a long and thin long piece part 20, and a holding part 22 which is provided at the back end of the long piece part 20. On the long piece part 20, a rack 24 for engaging with said gear 37 is, provided along one side. The holding part 22 is formed roughly in a recessed shape in section. On the opposite pieces of that recessed shape, an inner part 22*b* is formed one step shorter than an outer part 22*a*, and also a hole 23 is provided in the piece linking the opposite pieces together. A total size of the slider 2 has a length which extends from the front side (left side in FIG. 4) inside the case 10B until passing through the arc rib 15. The long piece part 20 is supported to slide freely on the arc rib 15, and the holding part 22 is supported to slide freely in the long groove 11.

The lock member 3 is the same as that in the first embodiment, and it is placed in a state in which it elastically contacts the inner part 22*b* of the holding part 22 via the two elastic pieces 30 and the striking part 31 is made to project out from the hole 23. Accordingly, the lock member 3 is placed on the holding part 22 in a direction orthogonal to (intersecting) the sliding direction of the slider 2, and is capable of moving accompanying the elastic deformation of the two elastic pieces 30. Usually, the lock member 3 is placed in the unlocked position with the head part 32 lightly contacting the inner surface of the other side in the lengthwise direction of the case as in FIG. 4. The lock member 3 is switched to the locked position in which the head part 32 is restricted in position on the side of the vertical wall 14*a*, by being displaced to sway in the direction orthogonal to the sliding direction of the slider 2 via the operating member 5 to be described later.

The spring member 4 is a constant-pressure spring in which a spring plate 42 wound around a spool 41 is drawn out from a housing 40, and is attached inside the case 10B on the front side. The spring member 4 has the drawn-out end of the spring plate 42 fixed by a suitable method to the holding part 22 of the slider 2. In the assembled state, the slider 2 is kept in the initial position in FIG. 4 against the force of the spring member 4 because the lock member 3 is in the unlocked position.

The operating member 5 is substantially the same as that in the first embodiment. The first cam part 47 enables switching of the lock member 3 from the unlocked position to the locked position as in FIG. 5(*b*). The second cam part 48 enables switching of the lock member 3 from the locked position to the unlocked position as in FIG. 5(*c*). The operating member 5 is attached to the front side of the inside bottom surface of the space part 7 on the side of the main body as in FIG. 4 and FIG. 9.

(Operation)

FIGS. 5(*a*) to 5(*d*) show the operation when using the sliding assisting device of the second embodiment. That is: FIG. 5(*a*) is a state in which the movable body 8 is in mid-course of being drawn out in which it is being drawn out manually from the drawn-in position in which it is held in the space part 7 on the side of the main body as in FIG. 4. In this process, the lock member 3 of the drawing-in unit main body 1B is in the unlocked position. Also, because the movable body 8 is drawn out while the damper 35 is idle-rotated, and the slider 2 is restricted in position via the lock member 3 and the operating member 5, the spring member 4 accumulates force in a gradually increasing manner accompanying the sliding of the movable body 8. The accumulation of force becomes maximum in the state in which the attachment positions of the slider 2 and the spring member 4 are most removed, as in FIG. 5(*b*).

FIG. 5(*b*) is a state in which the movable body 8 is further drawn out and is immediately before the lock member 3 is switched to the locked position by the operating member 5. In this process, the lock member 3 is displaced to sway to the locked position in the same drawing as a result of contacting the striking part 31 to the cam surface of the first cam part 47 and sliding in the direction of the vertical wall 14*a* by the cam action of the cam surface. Also, the movable body 8 is operated to slide up to the final drawn-out position while maintaining this state.

FIG. 5 (*c*) shows a state in which the movable body 8 is operated to be drawn in to the mid-course position from the drawn-out position. In this drawing-in process, when the lock member 3 has passed over the first cam part 47 of the operating member 5, the striking part 31 contacts with the second cam part 48 of the operating member 5, and by the cam action of that cam surface, the lock member 3 is slid to the lower side in the same drawing, that is, to the side of the long piece part 45 of the operating member 5, whereby it is switched to the unlocked position.

FIG. 5(*d*) shows a state in which the lock member 3 is switched to the unlocked position, whereby the movable body 8 is slid automatically by the force of the spring member 4 up to the final drawn-in position on the slider 2 which is restricted in position by the operating member 5. In this structure, while going from FIG. 5(*c*) to FIG. 5(*d*), the damper 35 damps the sliding speed of the movable body 8 via the engagement between the rack 24 and the gear 37. As a result, the movable body 8 comes to be slid at a moderate speed from the mid-course position to the final drawn-in position.

MODIFIED EXAMPLE

In the sliding assisting device of the second embodiment, just as with the modified example of the first embodiment, the drawing-in unit main body 1B may be placed on the main body 6 (for example, the inside bottom surface of the space part 7), and the operating member 5 may be placed on the movable body 8. In that modified example, the relationship of the members becomes a relationship as if viewed from the back of the paper surface of FIGS. 5(*a*) to 5(*d*). Also, operationally it is the same as the second embodiment.

Third Embodiment

In the sliding assisting device in FIG. 6, the drawing-out/drawing-in unit main body 1C is placed on the bottom surface side of the movable body 8, and the operating member 5 is placed on the inside bottom surface side of the space part 7 on the side of the main body. The drawing-out/drawing-in unit main body 1C is constituted by two sliders 2 which respectively are capable of sliding in the same direction as the movable body 8, lock members 3 which are built into each slider 2 and are capable of being displaced to sway in a direction roughly orthogonal to the sliding direction of the movable body 8, and a spring member 4 which is capable of accumulating force in the process of sliding of the movable body 8, and these are built into a case 10C.

The case 10C has a rectangular container shape which is long in the sliding direction of the movable body 8 and is flat as in FIG. 9. Of the two sidewalls facing opposite in the lengthwise direction, one sidewall part sticks out by an amount corresponding to a vertical wall 16 at back from about the center front-to-back. In the two sidewalls, a long groove 11 is formed from about the center position in the front-to-back direction to the back end as in FIG. 6. On the inside bottom surface, there are provided a roughly arc-shaped dividing rib 17 for damper placement in about the center front-to-back, and front-to-back ribs 18*a*, 18*b* which extend from the back side to near about the center front-to-back.

A damper 35 is placed inside the dividing rib 17. The dividing rib 17 forms a damper receiving part, and one part becomes a step part. The damper receiving part functions in the same manner as in the first embodiment, and the main body 36 of the damper 35 is made capable of rotating only in one direction via teeth or projections on the main body side and the step part on the side of the rib 17. In terms of shape, it is not limited to the shape in FIG. 6, and for example, it also may be designed to a shape such that the dividing rib 17 is rotated about 90 degrees. Also, the two front-to-back ribs 18*a*, 18*b* extend from the back wall to near the vertical wall 16, and the front sides of the ribs are connected together. A step-shaped restricting part 19*a* is provided on the front end side of the front-to-back rib 18*a*. A step-shaped restricting part 19*b* is provided likewise on the back end side of the front-to-back rib 18*b*. Each restricting part 19*a*, 19*b* is for fixing the lock member 3 on that vertical wall, just as the vertical wall 12*b* in FIG. 1 and the vertical wall 14*a* in FIG. 4. The case 10C, after building in the pair of sliders 2 and the lock members 3 as well as the spring member 4, is attached to the bottom surface of the movable body 8 by a setscrew, or the like.

The damper 35 is the same as that in the each of the embodiments above. The damper 35 idle-rotates when it rotates counterclockwise as in FIG. 8(*a*), and it damps the member on the other side (slider 2) via the gear 37 when-it rotates clockwise as in FIG. 8(*c*). In this structure, the main body 36 idle-rotates in one direction via the teeth on the outer perimeter, and damps only when the movable body 8 is slid by the force of the spring member 4 to be described later.

Each slider 2, just as in the first and second embodiments, has a long piece part 20 forming a rack 24, and a holding part 22 which is provided at the back end of the long piece part 20 and supports the lock member 3. On one slider 2 (the slider 2 placed on the lower side in FIG. 6, one side of the movable body 8), a fixing part 25 for spring is provided on the holding part 22. On the other slider 2 (the slider 2 placed on the upper side in FIG. 6, the other side of the movable body 8), there are provided a front-end bent part 26 in which the front end of the long piece part 20 is bent roughly in an L shape, and a step-shaped attachment piece part 27 which protrudes on the inside surface of the front of that front-end bent part 26. Also, the sliders 2 are placed inside the case 10C such that the racks 24 face opposite each other. The damper 35 is placed such that the gears 37 are placed between the racks 24 of each slider and engages one of the racks 24.

The lock member 3 is the same as that in the first embodiment, and it is placed in a state in which it elastically contacts with the inner part 22*b* of the holding part 22 via the two elastic pieces 30, and the striking part 31 is made to project out from the hole 23. Accordingly, the lock member 3 is placed on the holding part 22 in a direction orthogonal to the sliding direction of the slider 2, and becomes capable of moving accompanying the elastic deformation of the two elastic pieces 30. Usually, the lock member 3 of one slider 2 is placed in the unlocked position with its head part 32 lightly contacting with the side surface of the front-to-back rib 18*b*, and the lock member 3 of the other slider 2 is placed with its head part 32 on the step-shaped restricting part 19*a* of the front-to-back rib 18*a*, that is, in the locked position (position in which the movable body and the corresponding slider are operationally linked), as in FIG. 6.

The spring member 4 is a constant-pressure spring in which a spring plate 42 wound around a spool 41 is drawn out from a housing 40, and is attached to the step-shaped attachment piece part 27 of the other slider 2. The spring member 4 has the drawn-out end of the spring plate 42 fixed to the fixing part 25 provided on the holding part 22 of the one slider 2.

The operating member 5 is the same as that in the first and second embodiments, and the number used is the same number as that of the sliders 2 or lock members 3, that is, two. Also, each operating member 5 by the first cam part 47 enables switching of the corresponding lock member 3 from the unlocked position (position in which the operational link between the movable body and the corresponding slider is released) to the locked position as in each of FIG. 7(*b*) and FIG. 8(*b*). The second cam part 48 enables switching of the corresponding lock member 3 from the locked position to the unlocked position as in each of FIG. 7(*c*) and FIG. 8(*c*).

(Operation)

FIGS. 7(*a*) to 7(*d*) and 8(*a*) to 8(*d*) show the main operations when using the sliding assisting device of the third embodiment. FIG. 7(*a*) is a state in which the movable body 8 is in mid-course of being drawn out in which it is being drawn out manually from the drawn-in position in which it is held in the space part 7 on the side of the main body as in FIG. 6. In this process, of the plural sliders 2 constituting the drawing-out/drawing-in unit main body 1C, the lock member 3 of one slider 2 (the slider 2 placed at the lower side in the drawing, same below) is in the unlocked position, and the lock member 3 of the other slider 2 (the slider 2 placed at the upper side in the drawing, same below) is in the locked position. Also, because the movable body 8 is drawn out while the damper 35 is idle-rotated, and the one slider 2 is restricted in position via the lock member 3 and the operating member 5, the spring member 4 accumulates force in a gradually increasing manner accompanying the sliding of the movable body 8.

FIG. 7(*b*) is a state in which the movable body 8 is further drawn out and is immediately after the lock member 3 of one slider 2 is switched to the locked position by the operating member 5. In this process, the lock member 3 of the one slider 2 is displaced to sway to the locked position in the same drawing as a result of contacting the striking part 31 to the cam surface of the first cam part 47 and sliding the striking part 31 in the direction of the restricting part 19*b* by the cam action of that cam surface.

FIG. 7(*c*) shows a state in which the movable body 8 is further drawn out and is immediately after the lock member 3 of the other slider 2 is switched to the unlocked position by the operating member 5. In this process, the lock member 3 is displaced to the side of the long piece part 45, that is, the unlocking direction, as a result of contacting the striking part 31 to the cam surface of the second cam part 48 of the operating member 5 and sliding the striking part 31 by the cam action of that cam surface.

FIG. 7(*d*) is a state in which the lock member 3 of the other slider 2 is switched to the unlocked position (position in which the operational link between the movable body 8 and the slider 2 is released), whereby the movable body 8 is slid automatically by the force of the spring member 4 up to the final drawn-out position on the slider 2 which is restricted in position by the corresponding operating member 5. In this structure, while going from FIG. 7(*c*) to FIG. 7(*d*), the damper 35 damps the sliding speed of the movable body 8 via the engagement between the rack 24 of the other slider 2 and the gear 37. As a result, the movable body 8 slides at a moderate speed from the mid-course position to the final drawn-out position.

FIG. 8(*a*) shows a state in which the movable body 8 is operated to be drawn in to the mid-course position from the drawn-out position in FIG. 7(*d*). In this drawing-in process, in the initial stage, because the other slider 2 is restricted in position via the lock member 3 and the operating member 5, the spring member 4 accumulates force in a gradually increasing manner accompanying the sliding of the movable body 8. Also, at the stage when the lock member 3 of the other slider 2 has reached the restricting part 19*a* from the front-to-back rib 18*a* as in the same drawing, the striking part 31 is contacted with the cam surface of the first cam part 47, and the lock member 3 is displaced to sway in the direction of the restricting part 19*a*, that is, the locked position, by the cam action of that cam surface.

FIG. 8(*b*) shows a state in which the lock member 3 of the other slider 2 is switched to the locked position. In this state, because the lock members 3 of both sliders 2 are in the locked position, the movable body 8 and both sliders 2 are slid as one body in the direction of being drawn in.

FIG. 8(*c*) shows a state in which the movable body 8 is operated to be drawn in to the mid-course position and the lock member 3 of the one slider 2 is switched to the unlocked position. That is, in this drawing-in process, when the lock member 3 of the one slider 2 has passed over the first cam part 47 of the corresponding operating member 5 as in FIG. 8(*b*), the striking part 31 contacts with the second cam part 48 of the operating member 5, and by the cam action of that cam surface, the lock member 3 is slid to the lower side in the same drawing, that is, to the side of the long piece part 45 of the operating member 5, whereby it is switched to the unlocked position.

FIG. 8(*d*) shows a state in which the lock member 3 of the one slider 2 is switched to the unlocked position, whereby the movable body 8 is slid automatically by the force of the spring member 4 up to the final drawn-in position on the one slider 2 which is restricted in position by the corresponding operating member 5. In this structure, while going from FIG. 8(*c*) to FIG. 8(*d*), the damper 35 damps the sliding speed of the movable body 8 via the engagement between the rack 24 and the gear 37. As a result, the movable body 8 comes to be slid at a moderate speed from the mid-course position to the final drawn-in position.

MODIFIED EXAMPLE

In the third embodiment, just as with the modified example of the first embodiment, the drawing-out/drawing-in unit main body 1C may be placed on the main body 6 (for example, the inside bottom surface of the space part 7), and the operating member 5 may be placed on the movable body 8. In that modified example, the relationship of the members in FIGS. 7(*a*) to 7(*d*) becomes a relationship as if viewed from the back of the paper surface of the same drawing. Operationally, it is the same as the third embodiment. In order to achieve both drawing out and drawing in as above, it also can be considered to provide both the drawing-out unit main body 1A of the first embodiment and the drawing-in unit main body 1B of the second embodiment as a group. When it is the constitution of the third embodiment and its modified example, for example, there is an advantage of being simplified in that it is sufficient to have just one damper 35 and spring member 4.

The present invention is not to be restricted to the above embodiments and modified examples, and other than the essential conditions, it is capable of being modified suitably. Also, the sliding assisting device of the present invention has no particular constraint in terms of use. For example, if the movable body is a lid, the drawn-in position becomes the same meaning as the closed position which it is placed on a prescribed place of the main body, and the drawn-out position becomes the same meaning as the open position in which it is removed from the prescribed place of the main body. As for the damper 35, simplification is devised by making it as a constitution in which it damps only when rotating in one direction, and restricting the rotational direction by setting of the shape of the main body 36 on the damper receiving part, but there is no problem even if it is other than this type. For the spring member 4, although an example of a constant-pressure spring was given, it also may be a coil-spring or other forcing structure.

The disclosure of Japanese Patent Application No. 2004-099687, filed on Mar. 30, 2004, is incorporated in the application.

While the invention has been explained with reference to the specific embodiments of the invention, the explanation is illustrative and the invention is limited only by the appended claims.

What is claimed is:

1. A sliding assisting device installed between a movable body and a main body assisting the movable body to move between a first position and a second position relative to the main body, comprising:

a first unit provided on one of the main body and the movable body, and including a first slider capable of sliding in a direction that the movable body moves, a first lock member built in the slider and capable of moving in a direction substantially orthogonal to the direction that the movable body moves, and a spring member capable of accumulating force when the movable body moves from the first position to the second position or from the second position to the first position, and an operating member provided on the other of the main body and the movable body, said operating member displacing the first lock member from a locked position locking the movable body with the first slider to an unlocked position releasing the movable body from the first slider when the movable body is moved to a mid-course position from the first position or second position so that the movable body moves from the mid-course position to the first position or second position with the force of the spring member.

2. A sliding assisting device according to claim 1, wherein said first and second positions are drawing-in position and drawing-out position, respectively, relative to the main body so that when the movable body moves from the drawing-in position to the mid-course portion, the spring member accumulates the accumulating force to thereby automatically move the movable body from the mid-course position to the drawing-out position.

3. A sliding assisting device according to claim 1, wherein said first and second positions are drawing-in position and drawing-out position, respectively, relative to the main body so that when the movable body moves from the drawing-out position to the mid-course portion, the spring member accumulates the accumulating force to thereby automatically move the movable body from the mid-course position to the drawing-in position.

4. A sliding assisting device according to claim 1, further comprising a second unit provided on said one of the main body and the movable body where the first unit is installed, and including a second slider capable of sliding in the direction that the movable body moves, and a second lock member built in the second slider and capable of moving in the direction substantially orthogonal to the direction that the movable body moves, said spring member being disposed between the first and second sliders and capable of accumulating force when the movable body moves from the first position to the second position and from the second position to the first position, said operating member displacing the first lock member from the locked position locking the movable body with the first slider to the unlocked position releasing the movable body when the movable body is drawn out to the mid-course position from a drawn-in position, and displacing the second lock member from the locked position locking the movable body with the second slider to the unlocked position releasing the movable member when the movable body is drawing in to the mid-course position from a drawn-out position so that the movable body moves from the mid-course position to the drawn-out position and from the midcourse position to the drawn-in position with the force of the spring member.

5. A sliding assisting device according to claim 1, wherein said operating member includes a first cam part for displacing the first lock member to the locked position and a second cam part for displacing the first lock member to the unlocked position.

6. A sliding assisting device according to claim 4, wherein said operating member includes two members, each having a first cam part for displacing a corresponding lock member to the locked position and a second cam part for displacing the corresponding lock member to the unlocked position.

7. A sliding assisting device according to claim 1, further comprising a case retaining the first slider, the first lock member and the spring member, and a damper disposed in a damper receiving part inside the case for damping a speed of the movable body.

8. A sliding assisting device according to claim 7, wherein said damper includes a body and plural projections on an outer perimeter of the body, said damper being arranged to be capable of rotating in one direction via the projections relative to the damper receiving part.

9. A sliding assisting device according to claim 8, wherein said damper includes a gear for engaging a rack provided on the first slider.

* * * * *